US009683783B2

(12) United States Patent
Maggioli et al.

(10) Patent No.: US 9,683,783 B2
(45) Date of Patent: Jun. 20, 2017

(54) STAVE COOLER FOR A METALLURGICAL FURNACE AND METHOD FOR PROTECTING A STAVE COOLER

(71) Applicant: PAUL WURTH S.A., Luxembourg (LU)

(72) Inventors: Nicolas Maggioli, Thionville (FR); Nicolas Mousel, Dudelange (LU); Christian De Gruiter, Fentange (LU)

(73) Assignee: PAUL WURTH S.A., Luxembourg (LU)

( * ) Notice: Subject to any disclaimer, the term of this patent is extended or adjusted under 35 U.S.C. 154(b) by 0 days.

(21) Appl. No.: 15/108,521

(22) PCT Filed: Dec. 19, 2014

(86) PCT No.: PCT/EP2014/078632

§ 371 (c)(1),
(2) Date: Jun. 27, 2016

(87) PCT Pub. No.: WO2015/097073

PCT Pub. Date: Jul. 2, 2015

(65) Prior Publication Data

US 2016/0341476 A1 Nov. 24, 2016

(30) Foreign Application Priority Data

Dec. 27, 2013 (LU) ..... 92346

(51) Int. Cl.
*F27D 9/00* (2006.01)
*F27D 1/12* (2006.01)
(Continued)

(52) U.S. Cl.
CPC ..... *F27D 1/12* (2013.01); *C21B 7/106* (2013.01); *C21C 5/4646* (2013.01); *F27B 1/24* (2013.01);
(Continued)

(58) Field of Classification Search
CPC ..... C21B 3/0006; C21B 7/10; F27D 9/00
(Continued)

(56) References Cited

U.S. PATENT DOCUMENTS 3,881,860 A 5/1975 Brandenburg
6,221,312 B1 * 4/2001 Van Laar ..... C21B 13/0006 266/193
2013/0316295 A1 * 11/2013 Maggioli ..... C21B 7/10 432/77

FOREIGN PATENT DOCUMENTS

DE 2907511 A1 9/1980
DE 8909227 U1 9/1989
(Continued)

OTHER PUBLICATIONS

International Search Report issued Mar. 9, 2015 re: Application No. PCT/EP2014/078632, pp. 1-3, citing: DE 89 09 227 U1, GB 2 170 890 A and WO 2008/037836 A1.
(Continued)

*Primary Examiner* — Scott Kastler
(74) *Attorney, Agent, or Firm* — Cantor Colburn LLP

(57) ABSTRACT

A stave cooler for a metallurgical furnace includes a panel-like body having a front face for facing the interior of the metallurgical furnace, an opposite rear face, an upper face, an opposite lower face, and two side faces. At least one internal coolant passage is arranged within the panel-like body. The panel-like body is provided with a ledge on its front face extending between the side faces for being arranged in a horizontal plane. At least one protection element is provided for covering at least part of an upper face of the ledge. The protection element includes a first lateral portion, a second lateral portion, and a central portion. The lateral portions each include a widened front section and a narrow connection section. The panel-like body is provided with at least one through hole arranged for passing each of the lateral portions and the central portion of therethrough in turn.

12 Claims, 3 Drawing Sheets

(51) Int. Cl.

| | |
|---|---|
| ***C21B 7/10*** | (2006.01) |
| ***C21C 5/46*** | (2006.01) |
| ***F27B 1/24*** | (2006.01) |
| ***F27B 3/24*** | (2006.01) |

(52) U.S. Cl.
CPC ..... *F27B 3/24* (2013.01); *F27D 2009/0032* (2013.01)

(58) Field of Classification Search
USPC ..... 266/193
See application file for complete search history.

(56) References Cited

FOREIGN PATENT DOCUMENTS

| | | |
|---|---|---|
| GB | 2170890 A | 8/1986 |
| WO | 2008037836 A1 | 4/2008 |

OTHER PUBLICATIONS

Written Opinion issued Mar. 9, 2015 re: Application No. PCT/EP2014/078632, pp. 1-6, citing: DE 89 09 227 U1 and GB 2 170 890 A.

* cited by examiner

STAVE COOLER FOR A METALLURGICAL FURNACE AND METHOD FOR PROTECTING A STAVE COOLER

TECHNICAL FIELD

The present disclosure generally relates to a stave cooler for a metallurgical furnace. The disclosure also relates to a method for protecting a stave cooler, and in particular for protecting a ledge of such a stave cooler.

BACKGROUND

Stave coolers for a metallurgical furnace are well known in the art. They are used to cover the inner wall of the outer shell of the metallurgical furnace, such as e.g. a blast furnace or electric arc furnace, to provide: (1) a heat evacuating protection screen between the interior of the furnace and the outer furnace shell; and (2) an anchoring means for a refractory or metallic brick lining, a refractory guniting or a process generated accretion layer inside the furnace. Originally, the stave coolers have been cast iron plates with cooling pipes cast therein. As an alternative to cast iron staves, copper staves have been developed. Nowadays, most stave coolers for high heat loads for a metallurgical furnace are made of copper, a copper alloy or, more recently, of steel.

A copper stave cooler for a blast furnace is e.g. disclosed in German patent DE 2907511 C2. It comprises a panel-like body having a hot face (i.e. the face facing the interior of the furnace) that is subdivided by parallel grooves into lamellar ribs. The object of these grooves and ribs, which preferably have a dovetail (or swallowtail) cross-section and are arranged horizontally when the stave cooler is mounted on the furnace shell, is to anchor a refractory or metallic brick lining, a refractory guniting material or a process generated accretion layer to the hot face of the stave cooler. Drilled cooling channels extend through the panel-like body in proximity of the rear face, i.e. the cold face of the stave cooler, perpendicularly to the horizontal grooves and ribs.

The refractory or metallic brick lining, the refractory guniting material or the process generated accretion layer forms a protective lining arranged in front the hot face of the panel-like body. This protective lining is useful in protecting the stave cooler from deterioration caused by the harsh environment reigning inside the furnace. In practice, the protective lining is subject to erosion such that the panel-like body may be exposed to the harsh environment of the furnace, resulting, in turn, in damage to the stave cooler.

Abrasion of the protective lining and the stave cooler may further be caused by the accumulation of unreduced material against the protective lining or the stave cooler, especially at the bosh and belly level of the metallurgical furnace, which are the cylindrical, respectively conical convergent parts of the furnace.

In U.S. Pat. No. 3,881,860, the stave cooler is provided with a projection on its front face in order to support the protective lining. A cooling channel is arranged through the projection. U.S. Pat. No. 3,881,860 recognizes the problem that the protective lining can erode and thus expose the stave cooler, and especially its projection, to the harsh conditions in the metallurgical furnace. An attempt is made to avoid the problems of cooling fluid leaking into the furnace by providing improved cooling to the projection and thus prevent the projection from being damaged. This solution can however not adequately protect the protrusion, or the stave cooler itself, from being damaged by the harsh conditions reigning in the metallurgical furnace.

TECHNICAL PROBLEM

The present disclosure provides an improved stave cooler for a metallurgical furnace, wherein the stave cooler does not display the aforementioned drawbacks.

The disclosure further provides a stave cooler for a metallurgical furnace comprising

- a panel-like body having a front face for facing the interior of said metallurgical furnace, an opposite rear face, an upper face, an opposite lower face, and two side faces; at least one internal coolant passage arranged within said panel-like body; and
- a ledge on the front face extending between the side faces for being arranged in a horizontal plane
- wherein at least one protection element covers at least part of an upper face of said ledge. Each protection element includes a first lateral portion, a second lateral portion, and a central portion. Each of the first and second lateral portions has a widened front section and a narrow connection section, and
- wherein the panel-like body is provided with at least one through hole arranged for passing each of the first and second lateral portions and the central portion of the protection element therethrough in turn.

The disclosure also provides a method for protecting a stave cooler. The method includes the steps of: feeding a first lateral portion through a hole arranged in the panel-like body of the stave cooler, the first lateral portion comprising a first widened front section and a first narrow connection section; sliding the first lateral portion transversally to its insertion direction; and feeding a second lateral portion through the through hole, the second lateral portion comprising a second widened front section and a second narrow connection section. The method further includes the steps of sliding the second lateral portion transversally to its insertion direction; feeding a central portion through the through hole inbetween the first and second lateral portions; sliding the first and second lateral portions towards the central portion; feeding a wedge into slits created between the panel-like body and the protection element; and connecting an end plate to the protection element; the end plate bridging the wedge so as to form a tight form fit between the panel-like body and the protection element.

SUMMARY

A stave cooler for a metallurgical furnace, in particular for a blast furnace, in accordance with the present disclosure comprises a panel-like body having a front face for facing the interior of the metallurgical furnace, an opposite rear face, an upper face, an opposite lower face and two side faces. At least one internal coolant passage is arranged within the panel-like body. The panel-like body is provided with a ledge on its front face; the ledge extending between the side faces for being arranged in a horizontal plane. According to an aspect of the present disclosure, at least one protection element is provided for covering at least part of an upper face of the ledge.

It has been noted that ledges provided on the front faces of stave coolers not only serve as support for the protective lining, but also as protection for the stave cooler itself. Indeed, as the protective lining suffers erosion by descending burden, the stave cooler is at risk of being exposed and thus in turn likely to be damaged. The ledge however forms a stagnant zone above and below the ledge, in which stagnant zone, the protective lining is not eroded. It is therefore, in order to protect the stave cooler itself, the more important to prevent the ledge from being damaged. Providing the upper face of the ledge with a protection element helps maintaining the ledge and thus the stagnant zone, thereby protecting the stave cooler itself and prolonging its lifetime. The at least one protection element may be embodied in, in contact with or in the proximity of the upper face of the ledge.

The ledge is advantageously formed in one piece with the panel-like body, thus ensuring adequate heat transfer by conduction through the panel-like body through the continuity of material. Cooling channels arranged within the panel-like body may be arranged so as to extend into the ledge area so as to promote cooling of the ledge. It should however not be excluded to provide a ledge that is affixed to the panel-like body by means of e.g. screws. Such affixed ledges may be more easily exchangeable, should this be desired or necessary.

Advantageously, a plurality of protection elements are provided for covering the upper face of the ledge, the protection elements being arranged so as to cover essentially the whole width of the stave cooler. Such a plurality of protection elements is easy to install and replace and protect the ledge over the whole width of the stave cooler.

Each the protection element comprises a first lateral portion, a second lateral portion and a central portion; the first and second lateral portions each having a widened front section and a narrow connection section. The panel-like body is further provided with at least one through hole, which is arranged for passing each of the first and second lateral portions and the central portion of the protection element therethrough in turn. A comparatively small through hole can be used to consecutively feed constituent parts of the protection element from the rear face through the panel-like body. Such comparatively small through holes do not considerably weaken the structure of the stave cooler and do not interfere with the cooling channels arranged through the panel-like body. Nevertheless, the protection elements installed through such through holes are, after assembly, wider than the through hole so as to be able to cover the whole of the upper face of the ledge, thus protecting the ledge over the whole width of the stave cooler. It should also be noted that the protection element is preferably arranged flush with the front face of the ledge. However, the protection element may also be arranged so as to create a slight overhang, i.e. the protection element may protrude further into the furnace than the ledge. Such overhang may be of the order of about 10 mm.

Each connection section of the first and second lateral portion may have a cross-section narrowing in a direction away from the front section. Alternatively or additionally, the through hole may have a cross-section widening in direction of the rear face. This creates a narrowing slit within the through hole between the panel-like body and the protection element.

Fixing means provided for connecting the protection element to the panel-like body preferably comprises a wedge, preferably made from a double cone, inserted in the through hole between the panel-like body and the protection element; and an end plate bridging the wedge and connected to the protection element. Such a wedge may be inserted into the narrowing slit. As the end plate pushes the wedge further into the through hole, a tight connection is formed between the panel-like body and the protection element, thus tightly fixing the protection element to the panel-like body. Bolt or screw means may be provided for connecting the end plate to the protection element. Although the wedge is preferably formed in one piece, it is also conceivable to provide a plurality of wedge elements.

The front face of the panel-like body may comprise alternating retaining ribs and retaining grooves for retaining refractory material. Such grooves and ribs are useful in maintaining refractory material and process generated accretion layer against the front face of the panel-like body. Such a protective layer protects the panel-like body from excessive wear caused by the abrasive conditions reigning in the metallurgical furnace.

The stave cooler is preferably made from a material chosen in the group comprising copper, copper alloy, steel and steel alloy.

The protection element (or portions thereof) is preferably made from an abrasion resistant material chosen in the group comprising steel, steel alloys, cast iron, copper alloys or copper with hardfacing. It should also be noted that the constituent portions of the protection element, i.e. the first lateral portion, the second lateral portion and the central portion, are not necessarily made from the same material. Indeed, it may be advantageous for example to use a central portion made from a material having higher heat transfer capabilities.

The present disclosure further relates to a metallurgical furnace comprising a plurality of stave coolers as described above.

The disclosure also concerns a method for protecting a ledge of a stave cooler having a panel-like body, wherein the method comprises providing the ledge with a protection element. Preferably, the method comprises

- feeding a first lateral portion through a through hole arranged in the panel-like body of the stave cooler, the first lateral portion comprising a widened front section and a narrow connection section;
- sliding the first lateral portion transversally to its insertion direction;
- feeding a second lateral portion through the through hole, the second lateral portion comprising a widened front section and a narrow connection section;
- sliding the second lateral portion transversally to its insertion direction;
- feeding a central portion through the through hole inbetween the first and second lateral portions;
- sliding the first and second lateral portions towards the central portion;
- feeding a wedge into slits created between the panel-like body and the protection element; and
- connecting an end plate to the protection element; the end plate bridging the wedge so as to form a tight form fit between the panel-like body and the protection element.

BRIEF DESCRIPTION OF THE DRAWINGS

Preferred embodiments of the disclosure will now be described, by way of example, with reference to the accompanying drawings, in which.

DETAILED DESCRIPTION OF THE DRAWINGS

Stave coolers are used to cover the inner wall of an outer shell of a metallurgical furnace, as e.g. a blast furnace or electric arc furnace. The object of such stave coolers is to form: (1) a heat evacuating protection screen between the interior of the furnace and the outer furnace shell; and (2) an anchoring means for a refractory or metallic brick lining, a refractory guniting or a process generated accretion layer inside the furnace.

Figure 1:
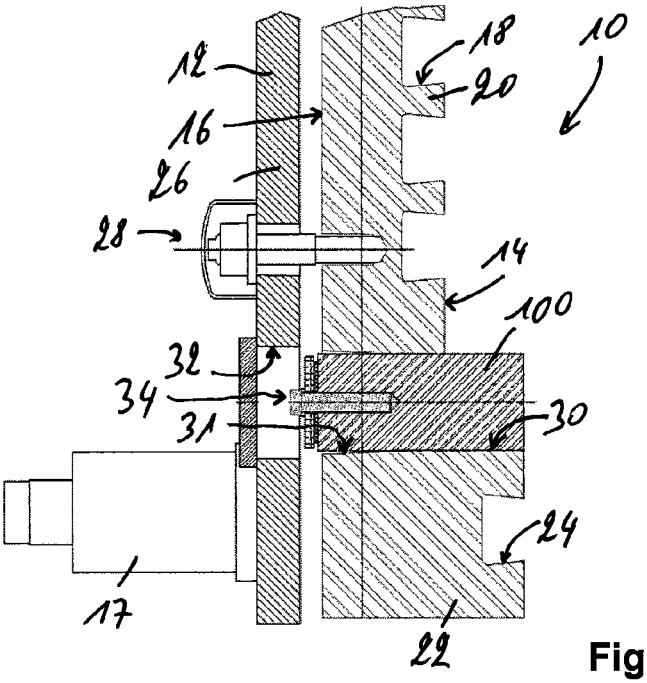
FIG. 1 is a schematic vertical cross-section through a portion of a stave cooler according to the disclosure.

Referring now to FIG. 1, it will be noted that the stave cooler 10 has a panel-like body 12, which is e.g. made of a cast or forged body of copper, a copper alloy or steel. This panel-like body 12 (of which only a lower portion is shown in FIG. 1) has a front face 14, also referred to as hot face, which will be facing the interior of the furnace, and a rear face 16, also referred to as cold face, which will be facing the inner surface of the furnace shell. The panel-like body 12 generally has the form of a quadrilateral with a pair of long first and second edges and a pair of short upper and lower edges. Most modern stave coolers have a width in the range of 600 to 1300 mm and a height in the range of 1000 to 4200 mm. It will however be understood that the height and width of the stave cooler may be adapted, amongst others, to structural conditions of a metallurgical furnace and to constraints resulting from their fabrication process. The panel-like body 12 may be plane or curved such as to fit the curvature of the metallurgical furnace.

The stave cooler 10 further comprises connection pipes 17 on the rear face 16 for circulating a cooling fluid—generally water—through cooling channels (not shown in FIG. 1) arranged within the panel-like body 12.

It will be noted that the front face 14 is subdivided by means of grooves 18 into lamellar ribs 20. Normally, the grooves 18 laterally delimiting the lamellar ribs 20 are machined into the panel-like body 12. These grooves 18 may however also be milled into the front face 14 of the panel-like body 12. When the stave cooler 10 is mounted in the furnace, the grooves 18 and lamellar ribs 20 are generally arranged horizontally. They form anchorage means for anchoring a refractory or metallic brick lining, a refractory guniting or a process generated accretion layer to the front face 14.

According to the present disclosure, the stave cooler 10 is provided with at least one ledge 22 arranged on the front face 14 of the panel-like body 12 and protruding therefrom. Such a ledge 22 may, as shown in FIG. 1 be arranged along a lower edge of the panel-like body 12. It should however not be excluded to arrange such a ledge along an upper edge or even in a central region of the panel-like body 12. The ledge 22 may also be provided with a groove 24 for forming anchorage means similar to the grooves 18. The ledge 22 is advantageously formed in one piece with the panel-like body 12, thus ensuring adequate heat distribution within the panel-like body 12 through the continuity of material. It should however not be excluded to provide a ledge that is affixed to the panel-like body 12 by means of e.g. screws. One advantage of such affixed ledges would be the fact that they would be exchangeable. FIG. 1 also shows a portion of a furnace shell 26 to which the stave 10 is connected using connection means 28.

According to the present disclosure, an upper face 30 of the ledge 22 is provided with a protection element 100. Such a protection element 100 is made from abrasive resistant material, such as steel, steel alloy, cast iron, copper alloy or copper with hardfacing, and protects the ledge 22 from erosion/abrasion by burden flowing through the furnace. The ledge 22 creates a stagnant zone above and below the ledge 22. Through this stagnant zone, the region of the stave cooler 10 above and below the ledge 22 is also protected from erosion. The protection element 100 does thus not only protect the ledge 22 from erosion, but also the region above and below that ledge. The whole stave cooler, or even stave cooler assembly, is therefore better protected against wear and its lifetime can be extended.

The panel-like body 12 is provided with a through hole 31 extending from the rear face 16 to the front face 14 for feeding the protection element 100 therethrough. An opening 32, which is in alignment with the through hole 31, is also provided in the furnace shell 26 for feeding the protection element 100 therethrough. This allows the protection element 100 to be installed and removed from the outside of the furnace. The protection element 100 is secured in place by means of fixing means 34 accessed from the rear face 16 of the stave cooler 10. A damaged protection element 100 may be replaced with a new or refurbished one by undoing the fixing means 34 and retracting the protection element 100 through the panel-like body 12 and the furnace shell 26. The new or refurbished protection element 100 can then be installed.

Figure 2:
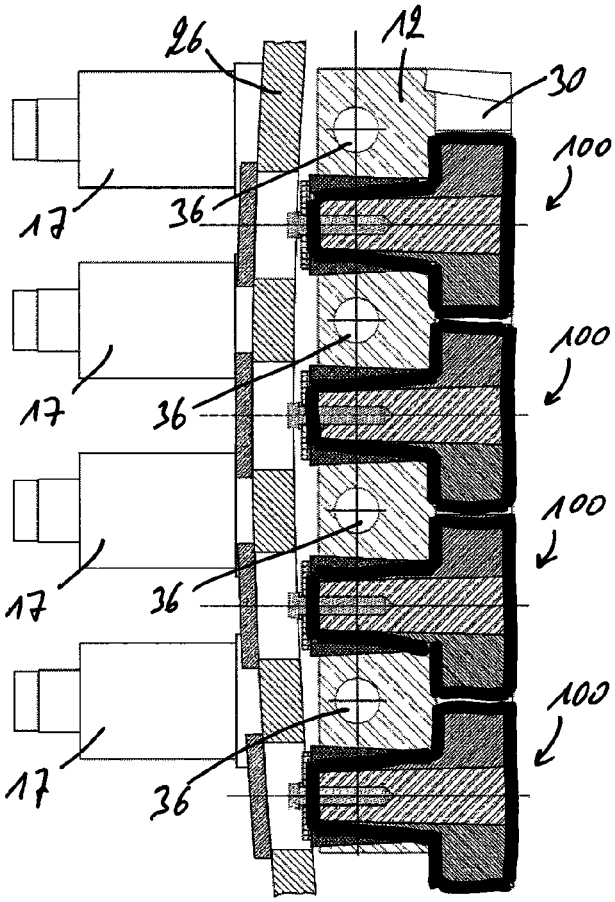
FIG. 2 is a horizontal cross-section through the stave cooler of FIG. 1 as seen from above.

Referring now to FIG. 2, a cross-section through a stave cooler 10 can be seen as viewed from above. This stave cooler 10 has a panel-like body 12 with four cooling channels 36 and associated connection pipes 17 for feeding cooling fluid through the stave cooler 10. Also visible are four protection elements 100 covering the upper face 30 of the ledge. Essentially, the protection elements 100 are arranged so as to largely cover the whole of the upper face 30 of the ledge along essentially the whole width of the stave cooler. Also noticeable is the fact that the protection elements 100 broadly have a T-shaped cross-section with a head considerably larger than the through holes 31 through which the protection elements 100 are fed. The head of the T-shaped protection element 100 forms the protection part covering the upper face 30 of the ledge, while the leg of the T-shaped protection element 100 forms the connection part located within the through hole 31.

The protection element 100, and especially the various parts constituting the protection element 100, will now be more closely explained by referring to FIGS. 3*a* to 3*f*, which show the installation sequence of a protection element 100.

Figure 3A:
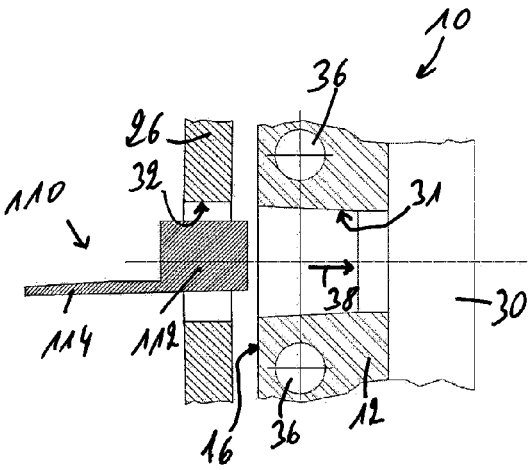
FIG. 3*a* to *f* is a schematic view of the assembly of a protection element of FIG. 1 in various installation sequences.

FIG. 3*a* shows a portion of a stave cooler 10 with a through hole 31 arranged through its panel-like body 12. As can clearly be seen, the through hole 31 is arranged inbetween two cooling channels 36. The cross-section of the through hole 31 widens in direction of the rear face 16 of the panel-like body 12, not only in order to facilitate insertion of the parts constituting the protection element 100, but also for aiding the fixing means 34 as will be seen later. In alignment with the through hole 31, the furnace shell 26 has an opening 32. A first constituting part of the protection element 100 is a first lateral portion 110 with a left-facing widened front section 112 and a narrow connection section 114. It will be noted that the first lateral portion 110 is narrower than the opening 32 or the through hole 31 such that it can be fed through these. Once the front section 112 of the first lateral portion 110 has passed through the through hole 31, the first lateral portion 110 is slid to the left with respect to the insertion direction represented by arrow 38 until the first lateral portion 110 is in the position shown in FIG. 3*b*.

Figure 3B:
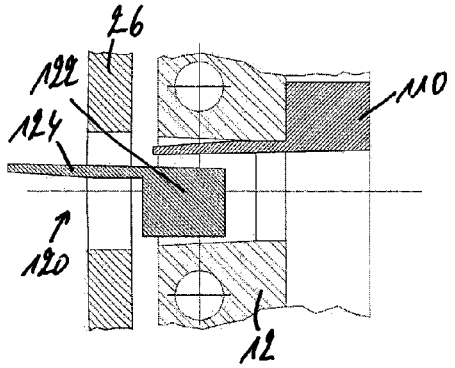

FIG. 3*b* shows a second constituting part of the protection element 100, which is a second lateral portion 120 with a right-facing widened front section 122 and a narrow connection section 124. It will be noted that the second lateral portion 120 is essentially a mirror image of the first lateral portion 110. Once the front section 122 of the second lateral portion 120 has passed through the through hole 31, the second lateral portion 120 is slid to the right with respect to the insertion direction represented by arrow 38 until the second lateral portion 120 is in the position shown in FIG. 3*c*.

Figure 3C:
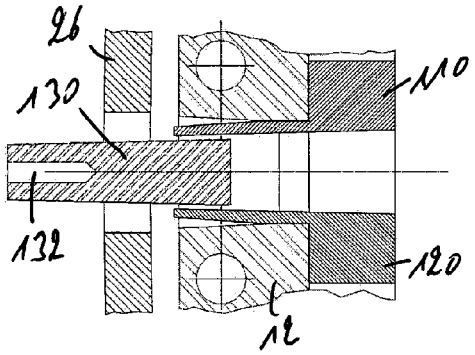
Figure 3D:
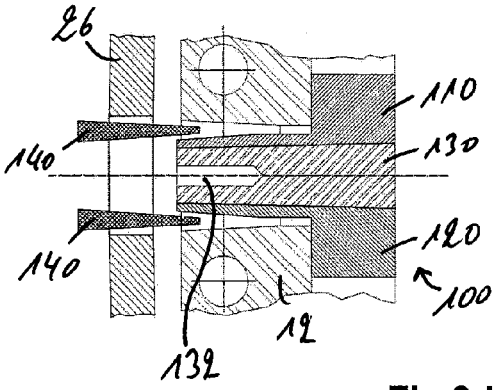

FIG. 3*c* then shows a third and final constituting part of the protection element 100: a central portion 130 is fed inbetween the first and second lateral portions 110, 120. Once the central portion 130 inserted, the first and second lateral portions 110, 120 are slid towards the central portion 130 to complete the protection element 100 as shown in FIG. 3*d*. The central portion 130 comprises, in its rear end, a threaded bore 132 for receiving a bolt or screw therein.

As mentioned above, the cross-section of the through hole 31 widens in direction of the rear face 16 of the panel-like body 12. Furthermore, FIG. 3*d* also shows that the connection sections 114, 124 narrow in direction of the rear face 16. A narrowing slit is thereby formed between the through hole 31 and the connection part of the protection element 100. The fixing means 34 comprises a wedge 140 inserted into the narrowing slit so as to create a tight connection between the panel-like body 12 and the connection part of the protection element 100. Such a wedge 140 may be made in one single piece and may have the shape of a double cone.

Figure 3E:
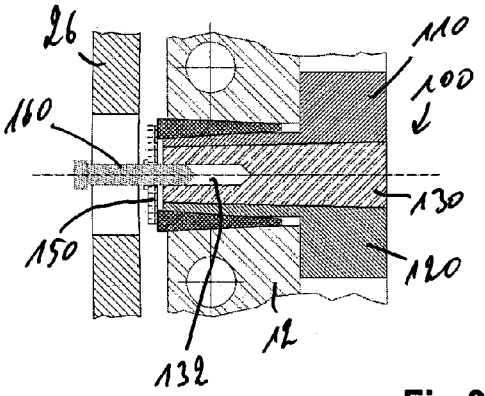

After insertion of the wedge 140, an end plate 150 bridging the wedge 140 is affixed to the central portion 130 of the protection element 100 by means of a bolt or screw 160 interacting with the treaded bore 132 as seen in FIG. 3*e*. As the screw 160 is tightened, the wedge 140 is pushed in the insertion direction 38 by the end plate 150, while the central portion 130 is pulled in the opposite direction. The wedge 140 is, through its wedge shape, creating tight lateral forces acting between the side walls of the through hole 31 and the connection portion of the protection element 100, thus firmly fixing the protection element 100 to the panel-like body 12.

Figure 3F:
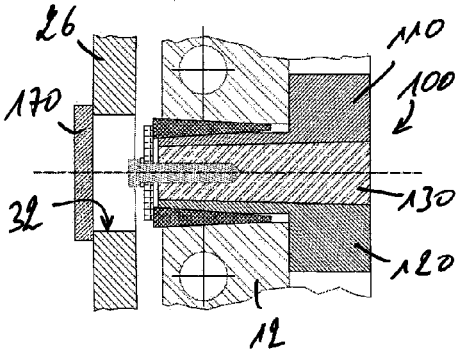

In FIG. 3*f*, the protection element 100 is shown in its fully installed position. After installation of the protection element 100, a cover 170 is connected, e.g. through welding, to the furnace shell 26 in order to close the opening 32 therein. A bolted flange can also be used to close the opening 32.

In order to remove a protection element 100, first the cover 170 is removed and then the screw 160 and the end plate 150. Subsequently, the wedge 140 is removed before the parts of the protection element 100 are removed in reverse order to the sequence described above. Because of the deformation or deterioration caused to the protection elements, it may not be possible to remove the latter through the through hole 31. If this is the case, the protection element 100 may be pushed into the furnace to be destroyed therein. Once the protection element 100 has been removed, a new one can be installed.

Figure 4:
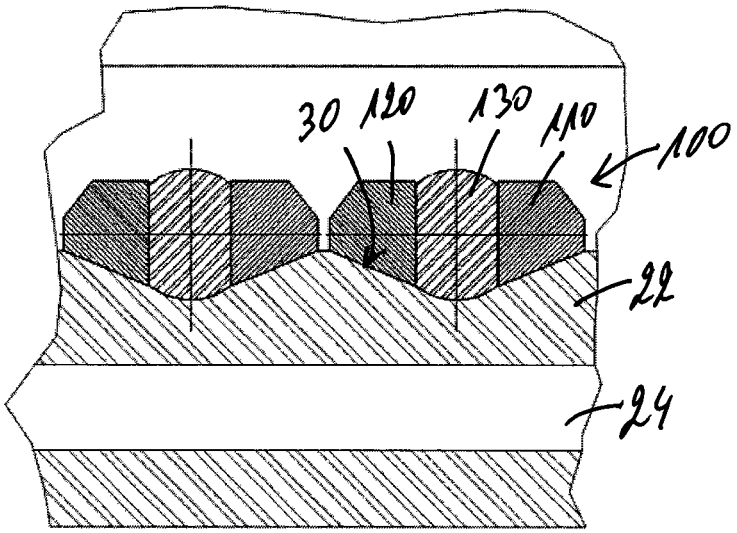
FIG. 4 is a cut through the protection element of FIG. 1.

Finally, FIG. 4 shows cut through the protection element 110. While the upper face 30 of the ledge 22 may be planar, it may also, as shown, have a wavy surface with the protection element 110 having a complementary shape. This ensures that the protection element 110 is correctly aligned and installed on the ledge 22.

The invention claimed is:

1. A stave cooler for a metallurgical furnace comprising:

a panel body having a front face for facing the interior of said metallurgical furnace, an opposite rear face, an upper face, an opposite lower face, and two side faces;

at least one internal coolant passage arranged within said panel body; and a ledge on said front face, said ledge extending between said side faces for being arranged in a horizontal plane wherein at least one protection element covering at least part of an upper face of said ledge, wherein each protection element comprises a first lateral portion, a second lateral portion, and a central portion, the first lateral portion being a separate component than the second lateral portion; each of said first and second lateral portions having a widened front section and a narrow connection section, and wherein said panel body is provided with at least one through hole arranged for passing each of said first and second lateral portions and said central portion of said protection element therethrough in turn.

2. The stave cooler according to claim 1, wherein a plurality of protection elements are provided for covering said upper face of said ledge, said protection elements being arranged so as to cover essentially the whole width of the stave cooler.

3. The stave cooler according to claim 1, wherein each connection section of said first and second lateral portions has a cross-section narrowing in a direction away from said front section.

4. The stave cooler according to claim 1, wherein said through hole has a cross-section widening in direction of said rear face.

5. The stave cooler according to claim 1, wherein fixing means are provided for connecting said protection element to said panel body; said fixing means comprising:

a wedge inserted in said through hole between said panel body and said protection element, and an end plate bridging said wedge and connected to said protection element.

6. The stave cooler according to claim 5, wherein said wedge is made of a double cone.

7. The stave cooler according to claim 5, wherein said fixing means comprises bolt or screw means for connecting said end plate to said protection element.

8. The stave cooler according to claim 1, wherein said front face comprises alternating retaining ribs and retaining grooves for retaining refractory material.

9. The stave cooler according to claim 1, wherein said panel body is made from a material selected from the group consisting of copper, copper alloy, steel, and steel alloy.

10. The stave cooler according to claim 1, wherein said protection element is made from an abrasion resistant material selected from the group consisting of steel, steel alloys, cast iron, and copper alloys or copper with hardfacing.

11. Metallurgical furnace comprising a plurality of stave coolers according to claim 1.

12. Method for protecting a ledge of a stave cooler having a panel body, wherein the method comprises providing said ledge with a protection element, wherein said method comprises the following steps:

feeding a first lateral portion through a through hole arranged in said panel body of said stave cooler, said first lateral portion comprising a first widened front section and a first narrow connection section;

sliding said first lateral portion transversally to its insertion direction;

feeding a second lateral portion, being a separate component than the first lateral portion, through said through hole, said second lateral portion comprising a second widened front section and a second narrow connection section;

sliding said second lateral portion transversally to its insertion direction;

feeding a central portion through said through hole inbetween said first and second lateral portions;

sliding said first and second lateral portions towards said central portion;

feeding a wedge into slits created between said panel body and said protection element; and connecting an end plate to said protection element; said end plate bridging said wedge so as to form a tight form fit between said panel body and said protection element.

* * * * *